United States Patent [19]

Stein

[11] 4,001,572

[45] Jan. 4, 1977

[54] DUSTPROOF AND AIRTIGHT LUMINAIRES

[76] Inventor: Marcel Stein, 560 Riverside Drive, New York, N.Y. 10027

[22] Filed: Aug. 8, 1975

[21] Appl. No.: 603,197

Related U.S. Application Data

[63] Continuation of Ser. No. 468,891, May 10, 1974, abandoned.

[52] U.S. Cl. ..... 240/25; 240/41.55; 277/34.3

[51] Int. Cl.[2] ..... F21S 1/10

[58] Field of Search ..... 240/25, 26, 41.55, 151; 355/92; 277/34, 34.3

[56] References Cited

UNITED STATES PATENTS

| | | | |
|---|---|---|---|
| 1,622,437 | 3/1927 | Freund | 240/41.55 |
| 3,092,336 | 6/1963 | Harling et al. | 240/25 |
| 3,297,865 | 1/1967 | Baldwin | 240/25 X |
| 3,854,040 | 12/1974 | Heiderer | 240/7.1 R |

*Primary Examiner*—Joseph F. Peters, Jr.
*Assistant Examiner*—Kenneth C. Hutchison
*Attorney, Agent, or Firm*—Hopgood, Calimafde, Kalil, Blaustein & Lieberman

[57] ABSTRACT

A luminaire provided with an inflatable gasket for airtight and dustproof sealing of its interior and for simultaneously gripping the cover of the luminaire in closed position while the gasket is inflated. The sealing forces act in a plane which is essentially perpendicular to the plane of symmetry of the cover. Untight closure of the cover is signaled by the visible displacement of the cover in case of deflation of the gasket.

6 Claims, 5 Drawing Figures

DUSTPROOF AND AIRTIGHT LUMINAIRES

This application is a continuation of application Ser. No. 468,891, filed May 10, 1974, now abandoned.

In the specification of my patent application Ser. No. 280,334 now U.S. Pat. No. 3,840,733 entitled METHOD AND DEVICE FOR IMPROVED MAINTENANCE OF LUMINAIRES submitted on Aug. 14, 1972 I described an inflatable gasket for the sealing of the interior of a liminaire and indicating means for signaling the lack of fluid pressure in the inflatable gasket and/or in the interior of the luminaire. The present invention relates to a luminaire with an inflatable gasket in which said gasket can be used as a means for either sealing the interior of the luminaire or for holding the luminaire cover in its closed position or both while the gasket is inflated. In case the gasket is deflated the visible displacement of the cover can serve as indicator for signalizing untight closure of the cover.

The inflatable gasket according to this invention has a toroidal or toroid-like form and is arranged either inside or outside the cover. This provides for sealing forces acting in a plane essentially perpendicular to the plane of symmetry of the cover when the gasket is inflated. A luminaire provided with this gasket has the following advantages as compared with luminaires known hitherto: 1. The stresses in the material of the cover are substantially reduced. 2. Effective stresses to which the cover is exposed can be further reduced by putting the cover and/or reflector under initial prestress. 3. The inflatable gasket can serve as a dual purpose device. While sealing the interior of the luminaire it simultaneously can also be used to hold the cover in its closed position when the gasket is inflated. Such a luminaire has a reduced number of parts and therefore is simpler and less expensive than the designs known hitherto. The visible displacement of the cover due to deflation and collapse of the dual purpose inflatable gasket can serve also as an indicator for the untight closure of the cover.

Further advantages of this invention will become more apparent from the description of advantageous embodiments thereof which follow: In these:

Figure 1:
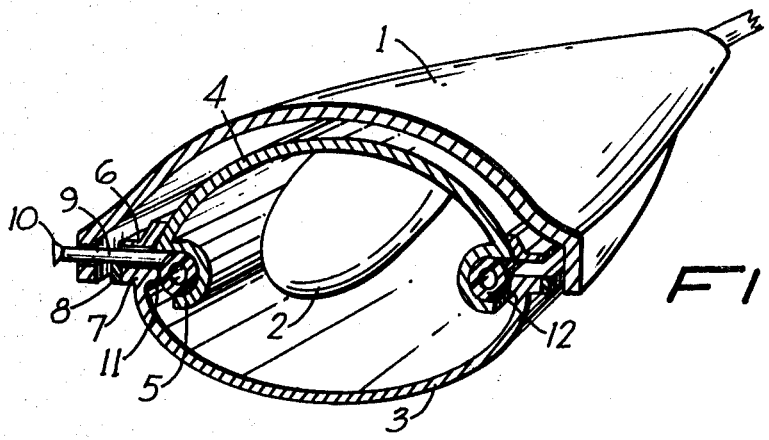
FIG. 1 is a cross-sectional perspective view of a luminaire with a dual purpose inflatable gasket arranged inside the cover of the luminaire.

In FIG. 1 an inflatable gasket 12 with a toroidal or toroid-like form is shown arranged inside a cover 3 of a luminaire body 1. The gasket simultaneously serves two purposes. First, it provides for the tight closure of an interior space between the cover and a reflector 4 containing an electric bulb 2. The gasket 12 can be inflated through a pipe 9 and its mouthpiece 10 from the outside as soon as cover 3 is in its closed position. The mouthpiece may contain a check valve of a type that is well known in the art. The plane of action of the sealing forces produced by the gasket on the cover and directed toward a sealing seat 11 of the cover 3 is essentially perpendicular to the plane of symmetry of the cover. Therefore, no axial sealing pressure is exerted by the gasket onto the cover. Due to this feature of the gasket the sealing force can be substantially reduced resulting in the prevention of breakage of the cover while a tight seal is ensured. The reflector 4 fastened to a luminaire body 1 contains a gasket housing or retaining ring 5 the concave part of which serves also as sealing surface for the inflatable gasket 12. Reflector 4 is also provided with a flange 6. The centerlines of an outside rim 7 and the sealing seat 11 of cover 3 are colinear. A metallic ring 8 is permanently applied under tension around rim 7 which puts the cover under compression prestress prior to the inflation of the gasket in order to reduce the effective stresss in it. Instead of a metallic ring a metal spring can also be used. The gasket is inflated after the closure of the cover by which the prestress in the cover is partly or completely released. The second role of the gasket 12 is to hold the cover 3 in its closed position while the gasket is inflated. The latter grips the cover 3 and holds it securely in its closed position due to the friction produced by these sealing forces.

Figure 2:
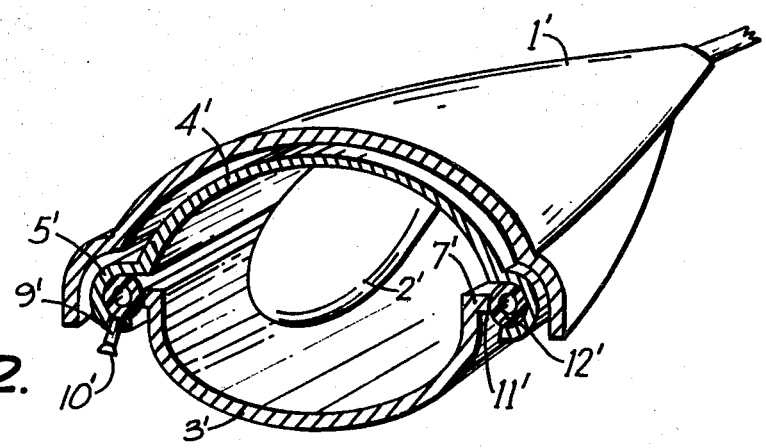
FIG. 2 is a cross-sectional perspective view of a luminaire with a dual purpose inflatable gasket arranged outside the cover.

FIG. 2 illustrates a dual purpose gasket 12' according to a second embodiment of the invention which is adapted to be arranged from the outside of a cover 3' of a luminaire body 1'. A reflector 4' includes a gasket housing or retaining ring 5' the concave part of which serves also as a sealing surface for the inflatable gasket 12'. Reflector 4' is fixed to the luminaire body. A lateral seat 11' for the gasket 12' is provided along a rim 7' of cover 3'. The inflation of gasket 12' places the cover 3' under compression. The latter is released by the pressure building up due to the thermal expansion of the fluid contained in the interior space between cover 3' and reflector 4' when an electric bulb 2' is in operation. The sealing pressures act in a plane essentially perpendicular to the symmetry axis of cover 3'. The sealing pressure due to the inflation of gasket 12' simultaneously generates frictional forces which securely grip and hold the cover 3' in its closed position.

Figure 3:
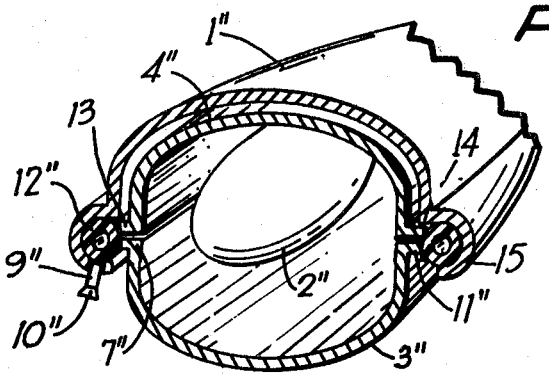
FIG. 3 is a cross-sectional perspective view of a luminaire in which the dual purpose inflatable gasket is arranged in a housing contained in the luminaire body.

FIG. 3 illustrates inflatable gasket 12'' according to yet another embodiment of the invention which is arranged in a housing or retaining ring 15 arranged on a luminaire body 1''. A reflector 4'' fixed to the luminaire body 1'' is provided with a sealing rim 13. Gasket 12'' is inflated through a mouthpiece 10'' and a pipe 9'' as soon as cover 3'' is in its closed position. The inner surface of the gasket expands inwardly while it is inflated and it presses against a lateral sealing seat of a rim 13 of reflector 4'' and against a lateral sealing seat 11'' of a rim 7'' of cover 3'', whereby the interior space between cover 3'' and reflector 4'' is sealed tightly. The sealing forces generate friction forces by which the cover is gripped smoothly and securely and held in its closed position. Should, however, the inflated gasket leak or otherwise be deflated, the cover 3'' would fall down due to gravity or spring forces when applied as soon as these friction forces cease to act unless some measures are taken to limit the displacement. Gasket 12'' also provides for the tight sealing of the space between the reflector 4'' and the luminaire body 1'' when the gasket is inflated due to the pressures exerted against the concave wall of the gasket housing or retaining ring 15 and against the sealing seat 11'' of cover 3'', respectively.

Figure 4:
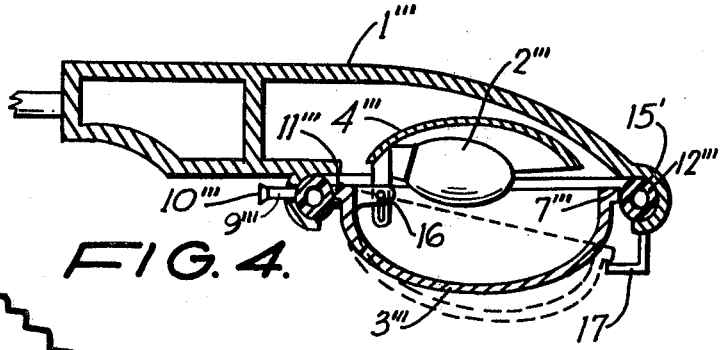
FIG. 4 represents a cross section of another embodiment of my invention in which a luminaire is sealed off by an inflatable gasket and also a visibly displaced cover is shown.

FIG. 4 shows the longitudinal section of a luminaire in which the interior space between a cover 3''' and luminaire body 1''' is undivided. In this case, the whole interior of the luminaire is sealed off by a dual purpose gasket 12''' pressing against the concave wall of a gasket housing or retaining ring 15' and a lateral sealing seat 11''', respectively. The parts of the luminaire of FIG. 4 as well as their functions are similar to those in the embodiments of FIGS. 1 to 3 and described above. Cover 3''' is pivotable around a hinge 16 located inside the luminaire and displacement of the cover due to the deflation of gasket 12''' is limited by the hook 17 fixed to luminaire body 1'''. The displaced position of cover 3''' shown in dotted lines in FIG. 4 can be observed remotely and serves as a signal to indicate the occurrence of a leaking gasket.

Figure 5:
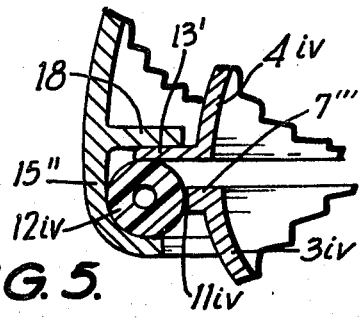
FIG. 5 shows a further advantageous embodiment of my invention in a partial cross section.

The luminaire body illustrated in FIG. 5 $1^{iv}$ is provided with a housing or retaining ring 15'' for an inflatable gasket $12^{iv}$ which seals off the interior space between a cover $3^{iv}$ and a reflector $4^{iv}$ by exerting radial sealing forces against a lateral sealing surface $11^{iv}$ of cover $3^{iv}$ and axial sealing forces against the flange 13' of reflector $4^{iv}$. The latter is supported by a rib 18 of luminaire body $1^{iv}$.

The retaining rings or housings for the toroidal or toroid-like inflatable gaskets described hereinabove represent embodiments of the invention in which the retaining rings form parts of the reflectors or luminaire bodies, respectively. It is, however, to be understood that such a retaining ring can also be made and adapted in luminaires as an independent part. It will thus be appreciated that modifications may be made in the embodiments of the invention herein particularly described without necessarily departing from the spirit and scope of the invention.

I claim:

1. In a luminaire including a light-transmissive cover having a first peripheral edge and at least one of a reflector and a housing overlying said cover when in a closed configuration of said luminaire and defining therewith an enclosure for containing a fluid and an illumination source therein, one of said reflector and housing having a second peripheral edge conforming to the shape of said first peripheral edge, said illumination source having the characteristic of producing heat when actuated whereby the pressure of said fluid within said enclosure is increased, the improvement which comprises: an arcuate peripheral member extending from one of said reflector and said housing and spaced from and extending beyond said cover, said peripheral member and said edge overlapping to define a gasket-retaining space, and an inflatable hollow gasket received in said gasket-retaining space and extending around the perimeter of said cover, said gasket being effective when inflated to exert a substantially transverse force acting on said cover, said gasket thereby being effective to reduce the net transverse tension stresses in said cover and to create a substantially airtight seal between said cover and one of said reflector and housing.

2. The luminaire of claim 1, wherein said cover includes a peripheral gasket seat extending transversely from said edge of said cover toward but spaced from said arcuate member.

3. The luminaire of claim 2, wherein said gasket seat extends outwardly and transversely from said cover.

4. The luminaire of claim 2, wherein said gasket seat extends transversely inwardly from said cover into said enclosure.

5. The luminaire of claim 1, in which said gasket also comprises means for exerting a substantially transverse force on said edge of said cover and creating a frictional force thereby to hold said cover in its closed position with one of said reflector and housing.

6. In a luminaire including a light-transmissive cover having a peripheral edge and at least one of a reflector and a housing overlying said cover when in a closed configuration of said luminaire and defining therewith an enclosure for containing a fluid and an illumination source therein, one of said reflector and housing having a second peripheral edge conforming to the shape of said first peripheral edge, said illumination source having the characteristic of producing heat when actuated whereby the pressure of said fluid within said enclosure is increased, the improvement which comprises: an arcuate peripheral member extending from one of said reflector and said housing and spaced from and extending beyond said cover, said peripheral member and said edge overlapping to define a gasket-retaining space, an inflatable hollow gasket received in said gasket-retaining space and extending around the perimeter of said cover, said gasket being effective when inflated to exert a substantially transverse force acting on said cover to create a substantially airtight seal between said cover and one of said reflector and housing, and a resilient member applied under tension around said arcuate peripheral member and effective to prestress said cover.

* * * * *